US006225884B1

(12) United States Patent
Fischer et al.

(10) Patent No.: US 6,225,884 B1
(45) Date of Patent: May 1, 2001

(54) CIRCUIT BREAKER WITH MECHANICAL TRIP LOAD TERMINAL/MAGNET BARRIER

(75) Inventors: Kenneth Martin Fischer, Finleyville; Mark Owen Zindler, Pittsburgh, both of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/469,441

(22) Filed: Dec. 21, 1999

(51) Int. Cl.[7] ..... H01H 9/02
(52) U.S. Cl. ..... 335/202; 218/22; 200/293
(58) Field of Search ..... 335/6, 8–10, 23–25, 335/202; 200/293–308; 218/22

(56) References Cited

U.S. PATENT DOCUMENTS

| | | | | |
|---|---|---|---|---|
| 4,242,577 | | 12/1980 | Maier et al. . | |
| 4,996,507 | | 2/1991 | McKee et al. . | |
| 5,291,165 | | 3/1994 | Whipple et al. . | |
| 5,321,378 | * | 6/1994 | Ferullo et al. | 335/202 |
| 5,341,191 | | 8/1994 | Crookston et al. . | |
| 5,444,423 | * | 8/1995 | Venzke et al. | 335/167 |
| 5,898,146 | | 4/1999 | Beck et al. . | |
| 5,945,650 | * | 8/1999 | Holland et al. | 218/1 |

* cited by examiner

*Primary Examiner*—Lincoln Donovan
*Assistant Examiner*—Tuyen T. Nguyen
(74) *Attorney, Agent, or Firm*—Martin J. Moran

(57) ABSTRACT

A circuit breaker having a magnetic trip assembly includes a load terminal conductor having a first section, a second section, and a transition section connecting the first section and the second section, the transition section having a pair of faces lying in a plane generally perpendicular to a surface of the second section; a current transformer positioned around the second section of the load terminal conductor, the current transformer having a first side positioned generally parallel to the faces of transition section; and an insulating barrier positioned between the first side of the current transformer and the faces of the transition section of the load terminal conductor, the insulating barrier having a generally planar portion and a pair of leg portions extending from one edge of the generally planar portion, each leg portion lying along a side of the second section of the load terminal conductor and having a protrusion positioned adjacent a distal end thereof, each of said protrusions being positioned adjacent a bottom edge of the second section of the load terminal conductor. Insulating barriers for use in such circuit breakers are also included.

1 Claim, 4 Drawing Sheets

CIRCUIT BREAKER WITH MECHANICAL TRIP LOAD TERMINAL/MAGNET BARRIER

BACKGROUND OF THE INVENTION

This invention is directed to electrical circuit breakers and, more particularly, to electrical circuit breakers having a trip mechanism including a magnetic device associated with a load terminal conductor.

Circuit breakers are generally old and well known in the art. Examples of circuit breakers are disclosed in U.S. Pat. Nos. 5,898,146 and 5,341,191. Such circuit breakers are used to protect electrical circuitry from damage due to an overcurrent condition, such as an overload condition or a relatively high-level short circuit condition.

Molded case circuit breakers include a pair of separable contacts per phase which may be operated either manually by way of a handle located on the outside of the case or automatically in response to an overcurrent condition. Circuit breakers include an operating mechanism which is designed to rapidly open and close the separable contacts, thereby preventing a moveable contact from stopping at any position which is intermediate between a fully open or a fully closed position. Circuit breakers also include a trip mechanism having a sensing device that senses overcurrent conditions in the automatic mode of operation; a trip bar responsive to the sensing mechanism; a trigger mechanism; and a latching and releasing mechanism. During an overcurrent condition, the trip bar responds to the sensing mechanism and releases the trigger mechanism. The trigger mechanism releases the latching and releasing mechanism, which, in turn, releases the operating mechanism thereby opening the separable contacts.

A typical sensing device is a current transformer positioned around a conductor that is connected to a load terminal of the breaker. It is desirable to prevent electrical contact between the current transformer and the adjacent conductor to prevent unwanted circulating currents in the current transformer components. Prior art circuit breakers have used an insulating barrier that included an opening for receiving the load terminal conductor. To install the barrier, the load terminal conductor had to be completely detached so that the barrier could be slid onto the conductor. It would be desirable to provide a circuit breaker with an insulating barrier that could be installed without the need to detach the load terminal conductor, but would still isolate the current transformer from the load terminal conductor.

SUMMARY OF THE INVENTION

A circuit breaker having a magnetic trip assembly includes a load terminal conductor having a first section, a second section, and a transition section connecting the first section and the second section, the transition section having first and second faces lying in a plane generally perpendicular to a surface of the second section; a current transformer positioned around the second section of the load terminal conductor, the current transformer having a first side positioned generally parallel to the face of transition section; and an insulating barrier positioned between the first side of the current transformer and the faces of the transition section of the load terminal conductor, the insulating barrier having a generally planar portion and a pair of leg portions extending from one edge of the generally planar portion, each leg portion lying along a side of the second section of the load terminal conductor and having a protrusion positioned adjacent a distal end thereof, each of said protrusions being positioned adjacent a bottom edge of the second section of the load terminal conductor. Insulating barriers, for use in such circuit breakers, are also included.

DESCRIPTION OF THE PREFERRED EMBODIMENT

Figure 1:
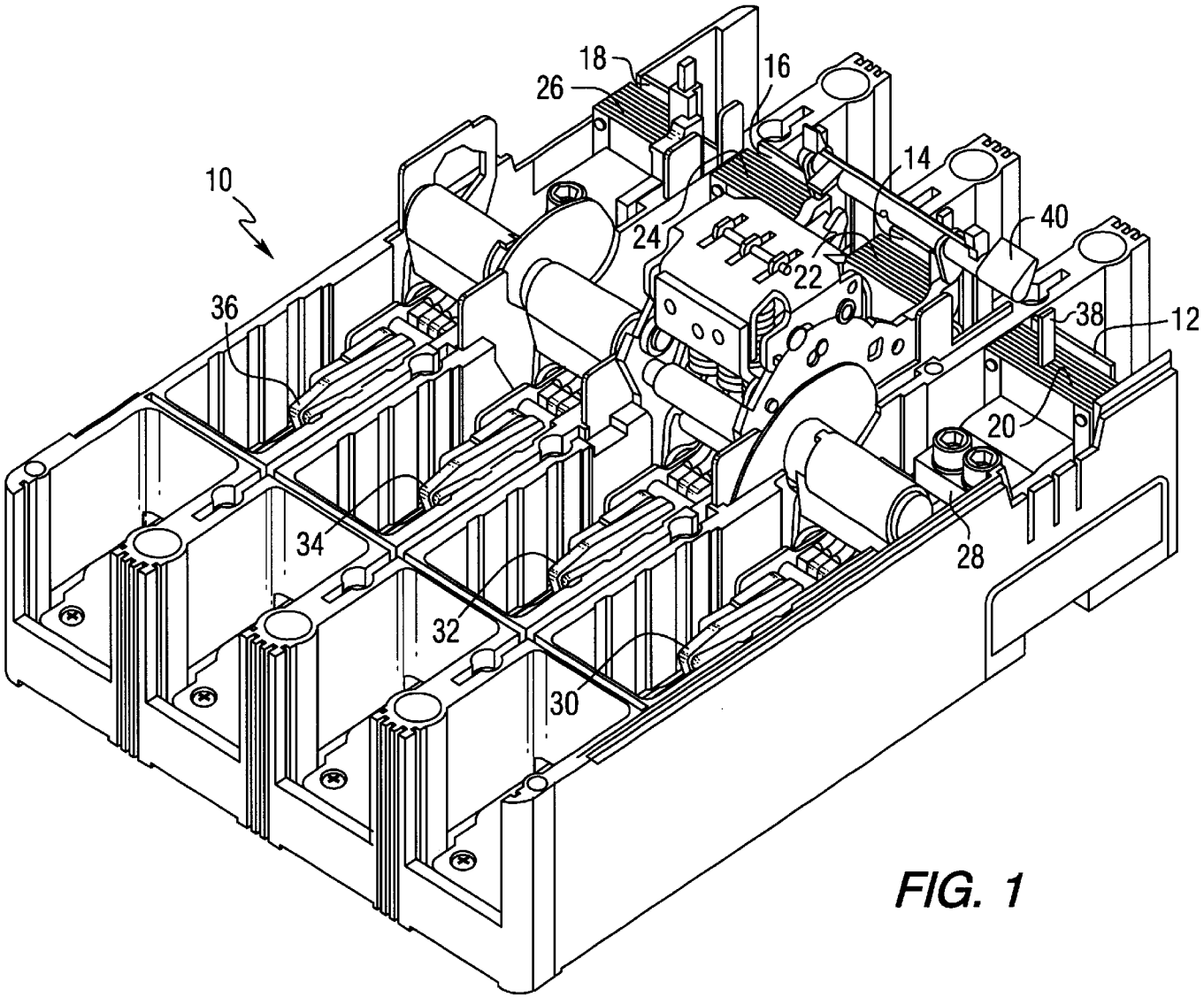
FIG. 1 is an isometric view of the relevant portions of a circuit breaker constructed in accordance with this invention.

Referring to the drawings, FIG. 1 is an isometric view of relevant portions of a circuit breaker 10 including a plurality of insulating barriers 12, 14, 16 and 18 constructed in accordance with the preferred embodiment of this invention. The circuit breaker includes a plurality of current transformers 20, 22, 24, and 26; each positioned around to a load terminal conductor. In this view, a portion of one of the load terminal conductors 28 is visible.

A trip unit serves to open the circuit breaker under certain conditions, and includes, for each phase, one of the current transformers for sensing load current. The current transformers are disposed about the load conductors and, in a manner well known in the art, detect current flowing through the separable contacts 30, 32, 34 and 36. In the event of an excessive current in one of the load conductors, the current transformer associated with that load conductor will sense the excessive current and operate a actuator 38 that is coupled to a trip bar 40. Movement of the trip bar results in the opening of the circuit breaker contacts in accordance with well-known techniques. The trip mechanism in this embodiment is constructed according to a known design, and the particular details of the trip mechanism are not important to the present invention. While the exemplary circuit breaker in FIG. 1 includes four sets of contacts, it will become apparent that the modular construction of the circuit breaker is easily adaptable for assembling similar circuit breakers with fewer or more contact sets.

Figure 2:
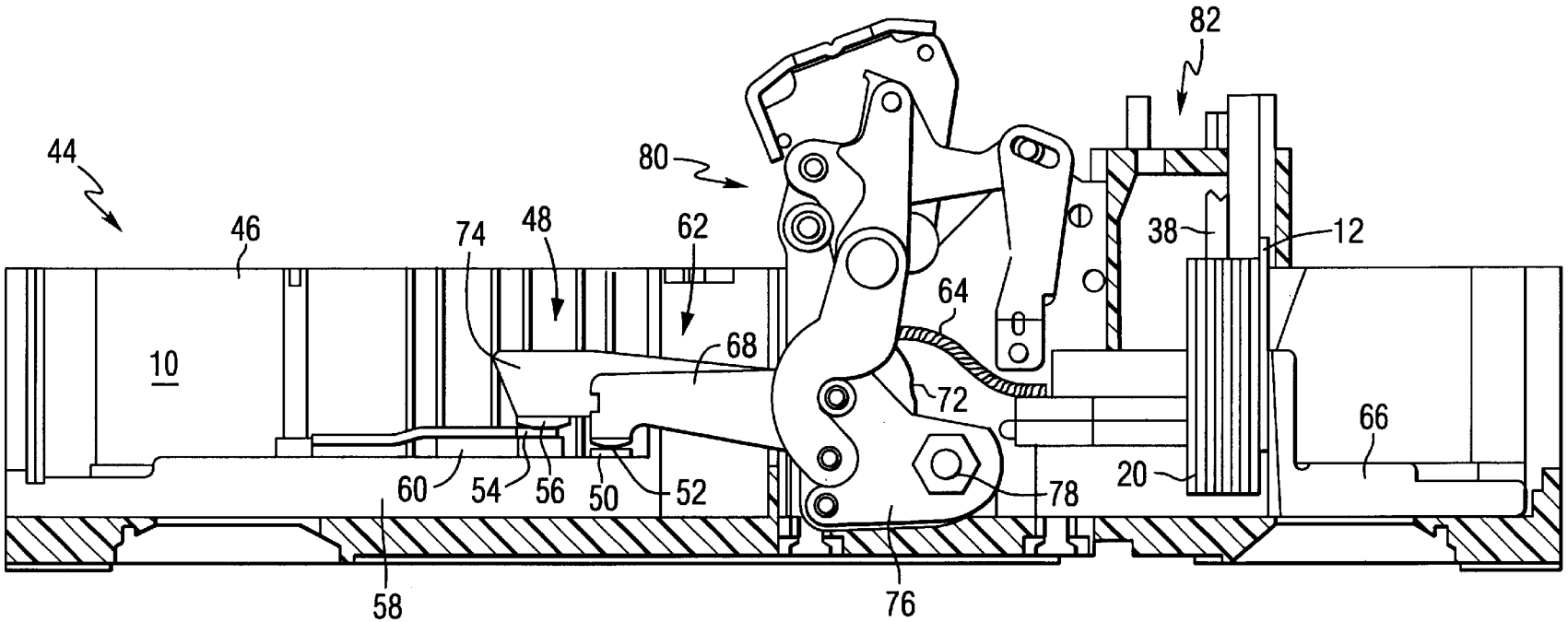
FIG. 2 is a longitudinal sectional view through the circuit breaker incorporating the invention.

FIG. 2 is a side view, partially in section, of one of the poles of the circuit breaker of FIG. 1. The circuit breaker 10 includes a molded housing 44 having a base section 46 and a cover (not shown). Each pole has a set of separable contacts 48, which includes a fixed main contact 50 and a moveable main contact 52. In addition, the separable contacts 48 include a fixed arcing contact 54 and a moveable arcing contact 56. The fixed main contact 50 is mounted on a line side conductor 58 electrically connected to a line side terminal (not shown) for connection to an external circuit (not shown). The fixed arcing contact 54 is mounted on a conductor 60 electrically connected to the line side conductor 58.

The moveable main contact 52 and moveable arcing contact 56 are mounted on a moveable conductor assembly 62, which is connected by flexible shunts 64 to a load side conductor 66, a terminal end of which serves as a load terminal. When the circuit breaker is closed as shown in FIG. 2, current from a source (not shown) connected to the line terminal (not shown) flows through the line side conductor 58, the separable contacts 48, the moveable conductor assembly 62, the flexible shunts 64, and the load side conductor 66 to a load (not shown).

The moveable conductor assembly 62 includes a contact arm 68 having a first or free end 70 and a second or supported end 72. The contact arm is assembled from a stack of main contact arm laminations 68 and arcing contact laminations 74. The moveable main contacts 52 are fixed to the free ends of the main contact arm laminations 68, while the moveable arcing contacts 56 are affixed to the free ends of the arcing contact arm laminations 74. As is known, the number of laminations is selected to provide the desired current rating for the circuit breaker.

Laminated contact arm 68 is supported by a contact arm carrier assembly 76 which in turn is rotatably mounted within the circuit breaker housing by a modular crossbar 78. The spring powered latchable operating mechanism 80 is pivotally connected to the carrier assembly 76 at the center pole for moving the contact arms 68, of all of the poles, between closed or open positions. Such spring powered operating mechanisms are well known in the art. A trip unit 82, responds to current flowing through the circuit breaker sensed by the current transformer 20 to unlatch the spring powered latchable operating mechanism 80 in response to selectable current conditions. Unlatching of the latchable operating mechanism 80 by the trip unit 82 causes the operating mechanism to rotate the carrier assemblies 76 and therefore the contact arms 68 to a "tripped" position to open the separable contacts and interrupt the load current.

Figure 3:
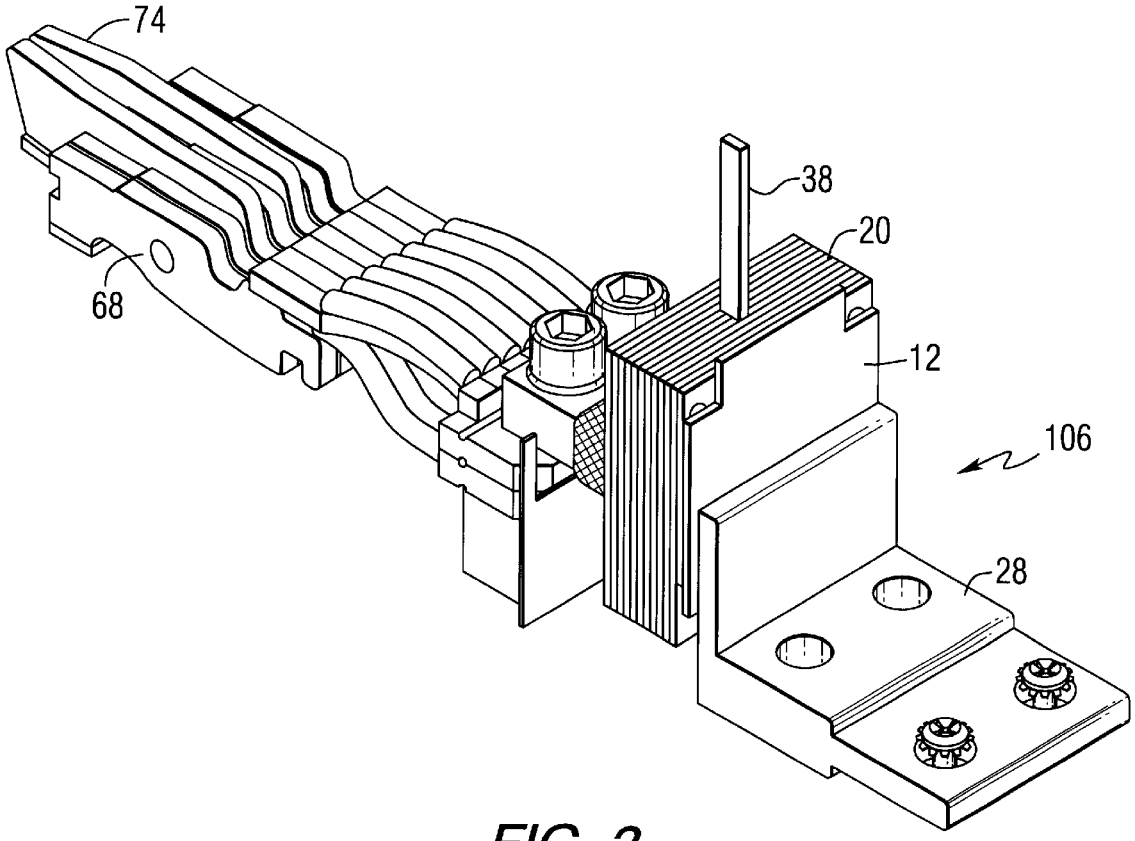
FIG. 3 is an isometric view of selected elements of the circuit breaker of FIG. 1.

FIG. 3 is an isometric view of selected components of the circuit breaker of FIGS. 1 and 2. In this view, the load terminal conductor is shown to include an offset portion 106 with the current transformer 20 being positioned around the load terminal conductor at a location adjacent to the offset portion. An insulating barrier 12 is positioned between the current transformer and the offset portion of the conductor to prevent electrical contact between the side of the current transformer and the offset portion of the conductor. Such contact would create unwanted circulating currents in the transformer.

Figure 4:
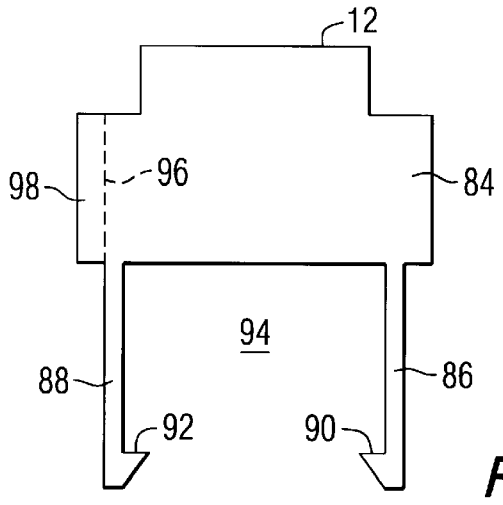
FIG. 4 is a plan view of the preferred embodiment of an insulating barrier used in the present invention.

FIG. 4 is a plan view of the preferred embodiment of an insulating barrier 12 used in the present invention. The insulating barrier is shown to include a generally planar portion 84, and a pair of legs 86 and 88 extending from one edge of the generally planar portion. Each of the legs includes a protrusion 90, 92 adjacent to one end thereof. The legs create an opening 94 for receiving a portion of the load terminal conductor having a generally rectangular cross section. The legs have sufficient length to extend beyond the sides of the conductor, so that the protrusions can latch on to the bottom surface of the conductor, thereby coupling the insulating barrier to the conductor. A score line 96 is provided in the generally planar portion of the barrier. This score line is aligned with an outer edge of one of the legs and permits easy removal of the section 98 of the planar portion that extends beyond the leg 88. By removing section 98, the barrier can be used on end poles of the breaker.

Figure 5:
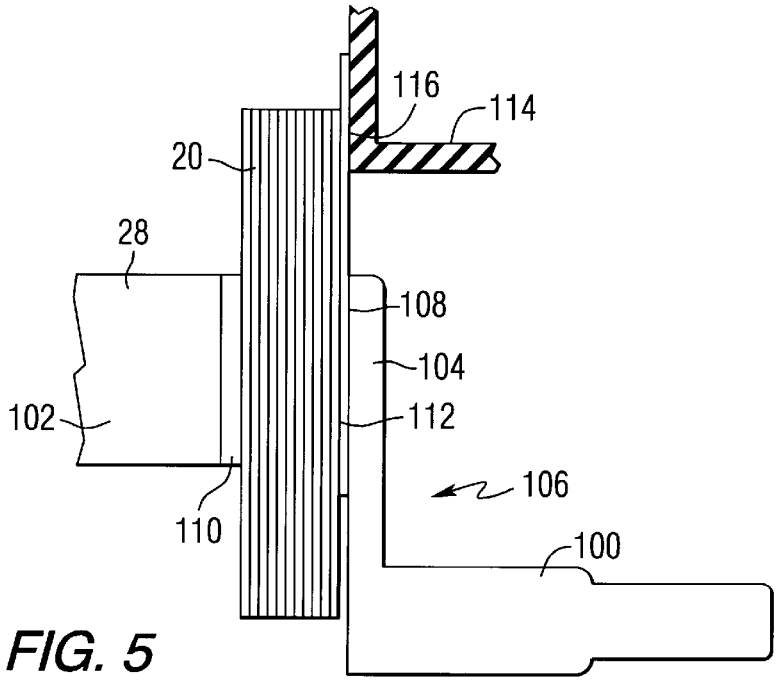
FIG. 5 is a side elevation view of selected elements of the circuit breaker of FIG. 1.

FIG. 5 is a side elevation view of the insulating barrier 12 of FIG. 4 positioned on a load conductor in a location that prevents contact of the sides of a current transformer with the conductor. The load conductor is seen to have a first section 100, a second section 102 and a transition section 104 that connects the first and second sections to form a bend, or offset, portion 106. As can be seen in FIG. 3, the transition portion of the load terminal conductor is slightly wider than the width of the second portion of the conductor. This results in a face 108 in a plane that is generally perpendicular to the top of section 102. A similar face is formed on the side of the conductor that is opposite to that shown in FIG. 5. Current transformer 20 is positioned around section 102 to detect the magnetic field resulting from current flowing in the load conductor. Insulation in the form of an insulating tape 110 is provided around the second section of the load conductor in the vicinity of the current transformer to prevent electrical contact between the walls of an interior aperture of the current transformer and section 102 of the load conductor. One side 112 of the current transformer lies generally parallel to face 108.

It is desirable to prevent electrical contact between the side 112 of the current transformer and the transition section of the load conductor. This prevents unwanted circulating currents from flowing in the current transformer lamination stack. Such electrical contact is prevented by an insulating barrier 12 positioned between the side of the current transformer and the face 108 of the load current conductor. One of the legs of the insulating barrier 86 extends along the side of section 102 of the load conductor. In this position, the projections 90 and 92 of the insulating barrier, as shown in FIG. 4, extend under the bottom surface of load conductor section 102, thereby latching the insulating barrier into place. With the particular insulating barrier structure shown in FIG. 3, the insulating barrier can be positioned onto the load conductor without having to disengage the conductor from its connection to the remainder of the circuit breaker. A breaker cover 114 is shown to have an interference fit at area 116 with the upper portion of the insulating barrier, further preventing movement of the barrier once it has been installed.

Figure 6:
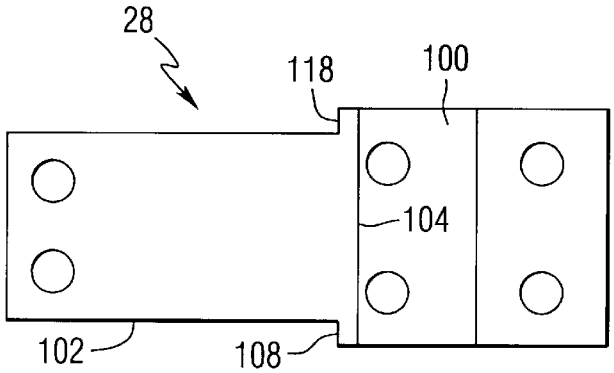
FIG. 6 is a top view of the load terminal conductor used in with the preferred embodiment of the invention.

FIG. 6 is a top view of a load terminal conductor used in the preferred embodiment of the invention. In this view, the second section 102 of the conductor 28 is seen to have a smaller width than the transition portion 104. This creates faces 108 and 118 that lie in a plane generally perpendicular to the surface of the second section 102 of the conductor. When the insulating barrier is installed, the legs of the barrier lie adjacent to these faces and between these faces and the side of the current transformer.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An insulating barrier for use in an electric circuit breaker, the insulating barrer comprising:

a generally planar portion and a par of leg portions extending from one edge f the generally planar portion and lying in a plane common with the generally planar portion, the leg portions defining an opening and each leg portion having a protrusion positioned adjacent a distal end thereof, wherein the protrusion extends toward the opening;

wherein the planar portion includes a first section and a second section, the first section extending laterally beyond a first one of the leg portions and the second section extending literally beyond a second one of the leg portions; and further comprising a score line in the planar portion, the score line being aligned with one of the leg portions and lying adjacent to the first section of the planar portion.

* * * * *